US010385719B2

(12) United States Patent
Maliniak et al.

(10) Patent No.: US 10,385,719 B2
(45) Date of Patent: Aug. 20, 2019

(54) VARIABLE VANE BUSHING

(71) Applicant: United Technologies Corporation, Farmington, CT (US)

(72) Inventors: David Maliniak, Branford, CT (US); Nathan F. Champion, Enfield, CT (US)

(73) Assignee: United Technologies Corporation, Farmington, CT (US)

( * ) Notice: Subject to any disclaimer, the term of this patent is extended or adjusted under 35 U.S.C. 154(b) by 460 days.

(21) Appl. No.: 14/914,089

(22) PCT Filed: Aug. 13, 2014

(86) PCT No.: PCT/US2014/050878
§ 371 (c)(1),
(2) Date: Feb. 24, 2016

(87) PCT Pub. No.: WO2015/031058
PCT Pub. Date: Mar. 5, 2015

(65) Prior Publication Data

US 2016/0208637 A1 Jul. 21, 2016

Related U.S. Application Data

(60) Provisional application No. 61/870,923, filed on Aug. 28, 2013.

(51) Int. Cl.
*F01D 9/04* (2006.01)
*F01D 17/14* (2006.01)
(Continued)

(52) U.S. Cl.
CPC ..... *F01D 17/14* (2013.01); *F01D 9/041* (2013.01); *F01D 17/162* (2013.01); *F01D 25/16* (2013.01);
(Continued)

(58) Field of Classification Search
CPC ..... F01D 17/14; F01D 17/16; F01D 17/162; F01D 9/041; F01D 9/042; F01D 9/02;
(Continued)

(56) References Cited

U.S. PATENT DOCUMENTS 3,695,777 A * 10/1972 Westphal ..... F01D 17/162 415/147
4,706,354 A 11/1987 Naudet et al.
(Continued)

FOREIGN PATENT DOCUMENTS

| | | |
|---|---|---|
| EP | 1205639 | 5/2002 |
| EP | 1967718 | 9/2008 |
| EP | 1967718 | 6/2013 |

OTHER PUBLICATIONS

International Search Report and Written Opinion for PCT/US2014/050878 dated Nov. 20, 2014.
(Continued)

*Primary Examiner* — Richard A Edgar
*Assistant Examiner* — Elton K Wong
(74) *Attorney, Agent, or Firm* — Carlson, Gaskey & Olds, P.C.

(57) ABSTRACT

A variable vane assembly includes a variable vane, a trunnion arranged on one end of the variable vane, an inner bushing configured to receive the trunnion in a press fit relationship, and an outer bushing configured to rotatably receive the inner bushing. A retention feature is configured to retain the trunnion axially with respect to the outer bushing. A gas turbine engine and a method of assembling a variable vane assembly are also disclosed.

17 Claims, 6 Drawing Sheets

(51) Int. Cl.
*F01D 17/16* (2006.01)
*F01D 25/16* (2006.01)
*F04D 29/56* (2006.01)

(52) U.S. Cl.
CPC ..... *F04D 29/563* (2013.01); *F05D 2220/32* (2013.01); *F05D 2230/60* (2013.01); *F05D 2260/36* (2013.01); *F05D 2260/37* (2013.01)

(58) Field of Classification Search
CPC ..... F01D 25/16; F01D 25/162; F04D 29/56; F04D 29/563; F05D 2220/32; F05D 2230/60; F05D 2260/36; F05D 2260/37; F16C 17/10; F16C 17/107
See application file for complete search history.

(56) References Cited

U.S. PATENT DOCUMENTS 4,792,277 A * 12/1988 Dittberner, Jr. ..... F01D 11/001 415/160
6,086,327 A 7/2000 Mack et al.
6,139,261 A * 10/2000 Bishop ..... F16C 3/00 384/281
6,386,763 B1 5/2002 Mack et al.
6,481,960 B2 11/2002 Bowen
6,682,299 B2 1/2004 Bowen et al.
6,767,183 B2 7/2004 Schilling et al.
7,094,022 B2 8/2006 Bruce
7,163,369 B2 1/2007 Bruce
7,207,770 B2 4/2007 Bruce
7,510,369 B2 3/2009 Lytle
7,670,106 B2 * 3/2010 Bouru ..... F01D 9/042 415/148
8,328,512 B2 12/2012 Major et al.
2003/0170115 A1 * 9/2003 Bowen ..... F01D 9/02 415/160
2007/0059161 A1 * 3/2007 Bouru ..... F01D 17/162 415/160
2008/0031730 A1 2/2008 Houradou et al.
2008/0298955 A1 12/2008 Major et al.
2011/0110783 A1 5/2011 Addis et al.
2012/0076658 A1 * 3/2012 Jarrett, Jr. ..... F01D 17/162 416/205
2013/0101385 A1 4/2013 Schilling
2013/0195651 A1 8/2013 Dube et al.

OTHER PUBLICATIONS

Extended European Search Report for European Application No. 14840189.6 dated Mar. 10, 2017.
International Preliminary Report on Patentability for PCT Application No. PCT/US2014/050878, dated Mar. 10, 2016.
Supplementary European Search Report for European Patent Application No. 14840189.6 dated Mar. 10, 2017.

* cited by examiner

VARIABLE VANE BUSHING

CROSS-REFERENCE TO RELATED APPLICATIONS

This application claims priority to U.S. Provisional Application No. 61/870,923, which was filed on Aug. 28, 2013.

GOVERNMENT CONTRACT

This invention was made with government support under Contract No. N00019-02-C-3003 awarded by the United States Navy. The government has certain rights in this invention.

BACKGROUND

This disclosure relates to a bushing for a variable vane assembly. More particularly, the disclosure relates to a bushing for an inner diameter of a variable vane that retains the vane and minimizes wear.

A gas turbine engine typically includes a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and a ground-based generator for industrial gas turbine engine applications. The compressor and turbine sections include a plurality of rotating blades and vanes spaced between the rows of blades. The vanes serve to direct and control the flow of air through the rows of blades.

One type of vane is a variable vane. In a variable vane, a vane pivots relative to a radial axis taken from a central axis of the engine. An actuator rotates a first side of the vane to pivot and a second opposed side of the vane is supported for rotation in a shroud. Typically, the actuator is at a radially outer location. In the event of a variable inlet vane failure, the rotated and supported sides of the vane may become disconnected from one another. The supported side of the vane may become liberated from the shroud and may be ingested by the rotating fan or other downstream rotating engine components. The supported side of the vane may include a retention feature to allow it to be retained in the shroud.

The supported side of the vane generally includes a bushing to facilitate rotation in the shroud. In some current designs, the bushing may be split to allow for the incorporation of a retention feature, reducing the contact area between the bushing and the supported side of the vane and the shroud. Additionally, material selection for bushings is typically limited due to the high-wear conditions in which they operate and the necessity for material matching with the supported side of the vane.

SUMMARY

In one exemplary embodiment, a variable vane assembly includes a variable vane, a trunnion arranged on one end of the variable vane, an inner bushing mated to the trunnion, an outer bushing configured to rotatably receive the inner bushing and a retention feature configured to retain the trunnion with respect to the outer bushing.

In a further embodiment of the foregoing embodiments, the retention feature is a flange formed on the inner bushing.

In a further embodiment of any of the foregoing embodiments, the flange is configured to abut an end of the outer bushing and prevent axial movement of the inner flange and the trunnion with respect to the outer bushing.

In a further embodiment of any of the foregoing embodiments, the outer bushing includes an anti-rotation feature.

In a further embodiment of any of the foregoing embodiments, the anti-rotation feature is at least one protrusion extending radially from an outer surface of the outer bushing.

In a further embodiment of any of the foregoing embodiments, the outer bushing includes at least one outer bushing flange.

In a further embodiment of any of the foregoing embodiments, the anti-rotation feature is at least one flat edge formed in the at least one outer bushing flange.

In a further embodiment of any of the foregoing embodiments, at least one of the inner and outer bushings are metallic.

In a further embodiment of any of the foregoing embodiments, the inner and outer bushings are made from the same material.

In a further embodiment of any of the foregoing embodiments, the inner bushing is mated to the trunnion in a press fit relationship.

In another exemplary embodiment, a gas turbine engine includes a shroud having a recesses, a variable vane including first and second trunnions at first and second ends of the variable vane, respectively, an inner bushing configured to receive the first trunnion in a press fit relationship, an outer bushing configured to rotatably receive the inner bushing, the outer bushing arranged in the recess, a retention feature configured to retain the first trunnion axially with respect to the outer bushing, and an actuator configured to rotate the variable vane via the second trunnion.

In a further embodiment of any of the foregoing embodiments, the retention feature is a flange formed on the inner bushing.

In a further embodiment of any of the foregoing embodiments, the outer bushing includes an anti-rotation feature.

In a further embodiment of any of the foregoing embodiments, the shroud is configured to mate with the anti-rotation feature.

In a further embodiment of any of the foregoing embodiments, the first trunnion is radially inwards from the second trunnion with respect to a central axis of the gas turbine engine.

In another exemplary embodiment, a method of assembling a variable vane assembly includes installing a trunnion of a variable vane into an inner bushing in a press fit relationship, installing the inner bushing into an outer bushing to create a bushing assembly, and retaining the trunnion in the bushing assembly via a retention feature on the inner bushing.

In a further embodiment of any of the foregoing embodiments, the method further includes the step of installing the bushing assembly into a shroud.

In another embodiment of any of the forgoing embodiments, the method further includes the step of rotating the variable vane with respect to the shroud.

In another embodiment of any of the forgoing embodiments, the method includes the step of preventing rotation of the outer bushing relative to the shroud via an anti-rotation feature.

BRIEF DESCRIPTION OF THE DRAWINGS

The disclosure can be further understood by reference to the following detailed description when considered in connection with the accompanying drawings wherein.

DETAILED DESCRIPTION

Figure 1:
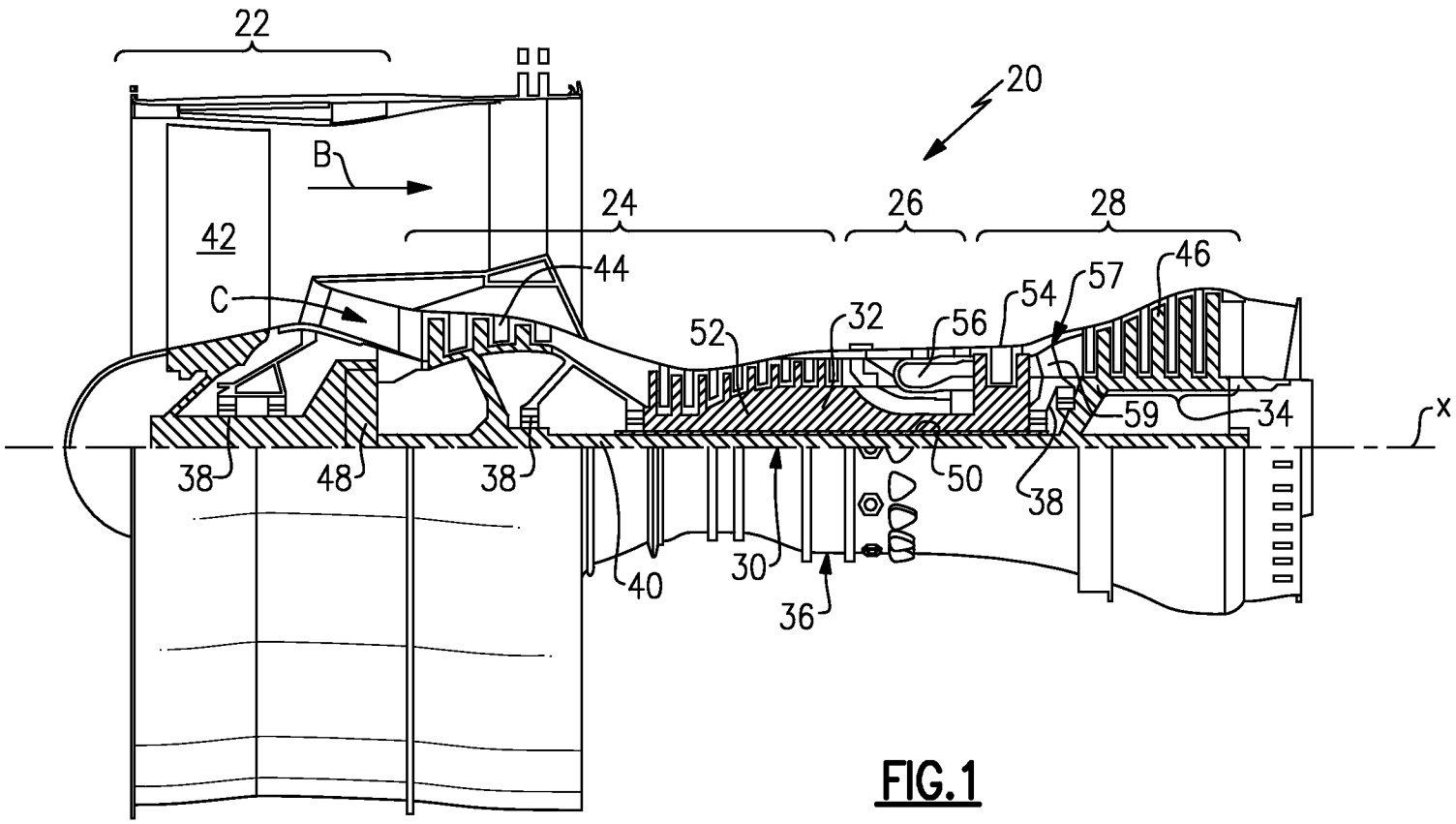
FIG. 1 schematically illustrates an example industrial gas turbine engine.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis X relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis X.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about five (5). The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 57 of the engine static structure 36 is arranged generally between the high pressure turbine 54 and the low pressure turbine 46. The mid-turbine frame 57 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 57 includes vanes 59, which are in the core airflow path and function as an inlet guide vane for the low pressure turbine 46. Utilizing the vane 59 of the mid-turbine frame 57 as the inlet guide vane for low pressure turbine 46 decreases the length of the low pressure turbine 46 without increasing the axial length of the mid-turbine frame 57. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of [(Tram ° R)/(518.7° R)] 0.5. The "Low corrected fan tip speed", as disclosed herein according to one non-limiting embodiment, is less than about 1150 ft/second.

Figure 2:
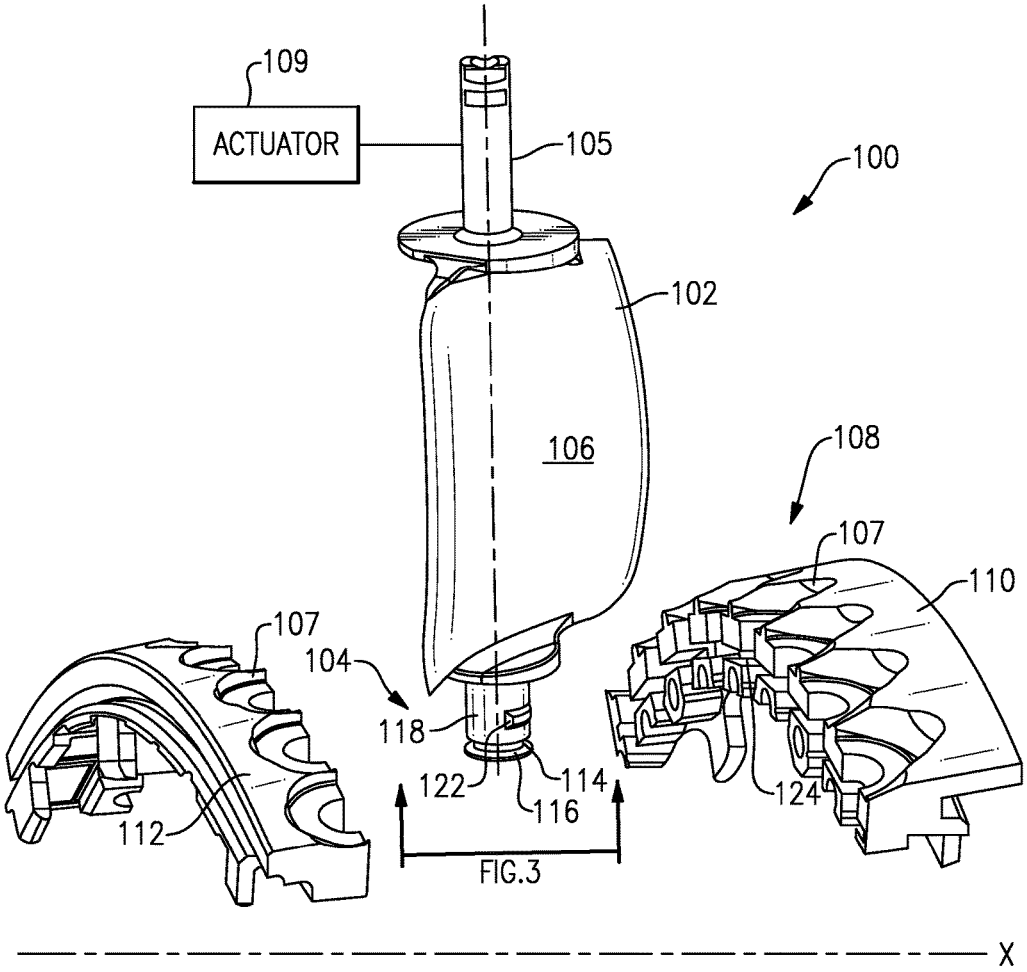
FIG. 2 illustrates a variable vane assembly.
Figure 3:
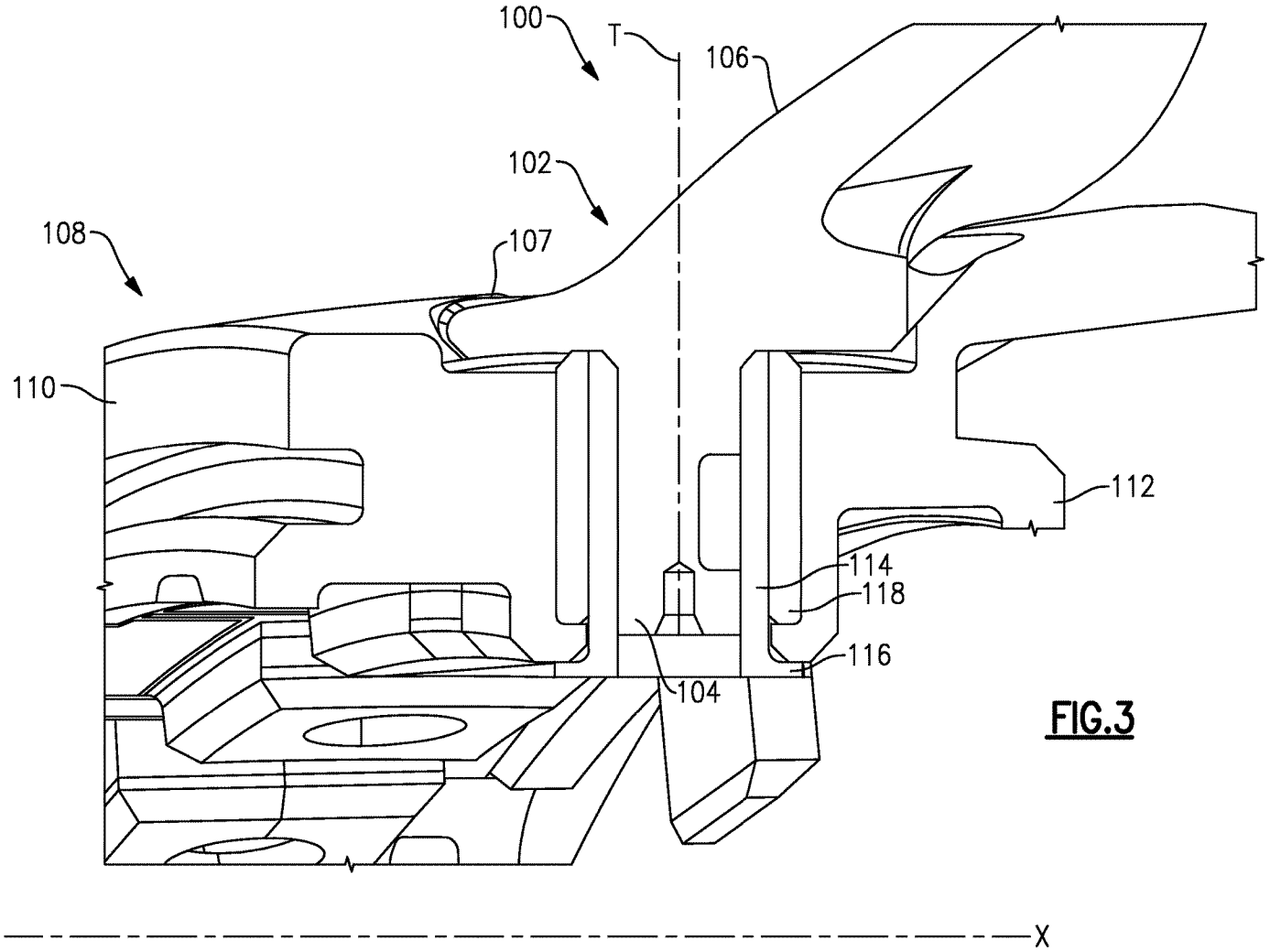
FIG. 3 illustrates a cross-sectional view of a portion of the variable vane assembly on FIG. 2.

Referring to FIGS. 2-3, an example variable vane assembly 100 is shown. A variable vane 102 includes first and second trunnions 104, 105 and an airfoil 106. The first trunnion 104 is arranged in a recess 107 in a shroud 108. The shroud 108 may be circumferentially split into first and second halves 110, 112. In one example, the first trunnion 104 is located on a radially inner side of the variable vane 102 with respect to the engine axis X, and the second trunnion 105 is located on a radially outer side of the variable vane 102. The second trunnion 105 may be actuated by an actuator 109. The actuator 109 causes the vane to pivot about an axis T of the trunnion 104. In another example, the first trunnion 104 may be connected to the actuator 109 and the second trunnion 105 may be supported in the shroud.

The trunnion 104 is arranged in an inner bushing 114. The inner bushing 114 includes a retention feature. The retention feature may be a flange 116. In this example, the trunnion 104 and the inner bushing 114 are mated in a press fit relationship. However, in another example, the trunnion 104 may be mated to the inner bushing 114 in another fashion. The inner bushing 114 is arranged in an outer bushing 118. The outer bushing is received in the recess 107.

Figure 4:
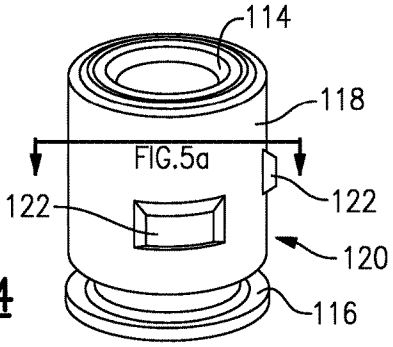
FIG. 4 illustrates a bushing assembly.

FIG. 4 shows the inner and outer bushings 114, 118 which together form a bushing assembly 120. The flange 116 mates the inner bushing 114 to the outer bushing 118 by preventing axial movement of the inner bushing 114 away from the engine axis X. In one example, the vane 102 may be installed in the bushing assembly 120. Then, the bushing assembly 120 may be installed into the shroud 108. The inner bushing 114 is retained in the outer bushing 118 by the flange 116. The press fit relationship between the trunnion 104 and the inner bushing 114 (FIG. 3) retains the vane 102 in the inner bushing 114. This arrangement serves to retain the vane 102 in the bushing assembly 120 and the shroud 108 via the inner and outer bushings 114, 118.

Figure 5B:
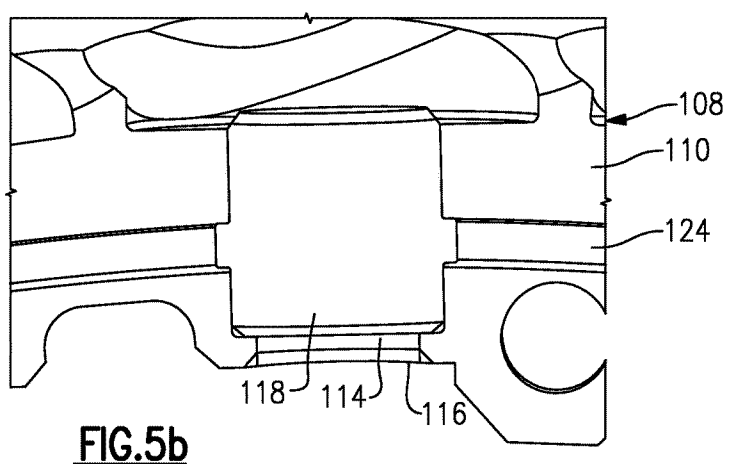
FIG. 5*b* illustrates the bushing assembly of FIG. 4 installed in a shroud.
Figure 6:
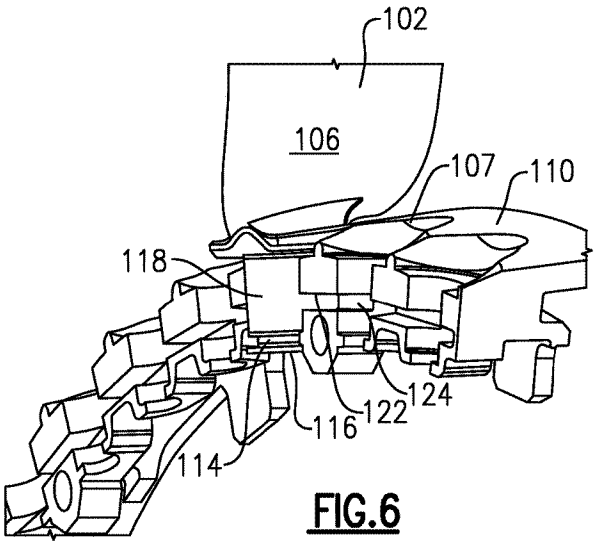
FIG. 6 illustrates a portion of the variable vane assembly of FIG. 2 installed in the shroud.
Figure 5A:
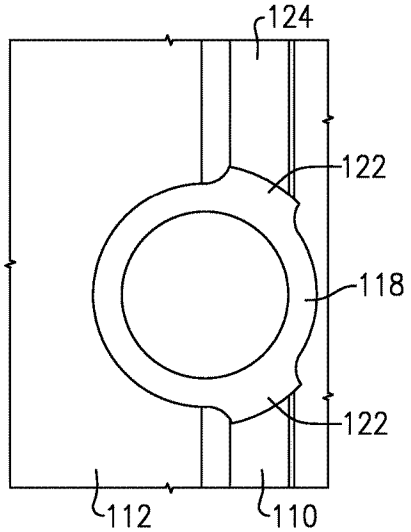
FIG. 5*a* illustrates a cress sectional view of the bushing assembly of FIG. 4.

The outer bushing 118 includes one or more anti-rotation features. The anti-rotation features may be protrusions 122 which extend radially outward from an outer surface of the outer bushing 118. Referring to FIGS. 5*a-b* and FIG. 6, the protrusions 122 are received in a slot 124 in the first half 110 of the shroud 108, preventing the outer bushing 118 from rotating about the trunnion axis T (FIGS. 2-3).

Because the primary wear takes place between the inner and outer bushings 114, 118, a variety of materials can be matched to provide the desired wear characteristics. In one example, both the inner and outer bushings 114, 118 may be metallic. For example, the metal may be a steel or steel alloy, a nickel-chromium alloy such as Inconel 625 or Inconel 718, or a cobalt-chromium alloy such as Haynes 25. The inner and outer bushings 114, 118 may be made of the same or different materials, and may have coatings or surface treatments.

Figure 7B:
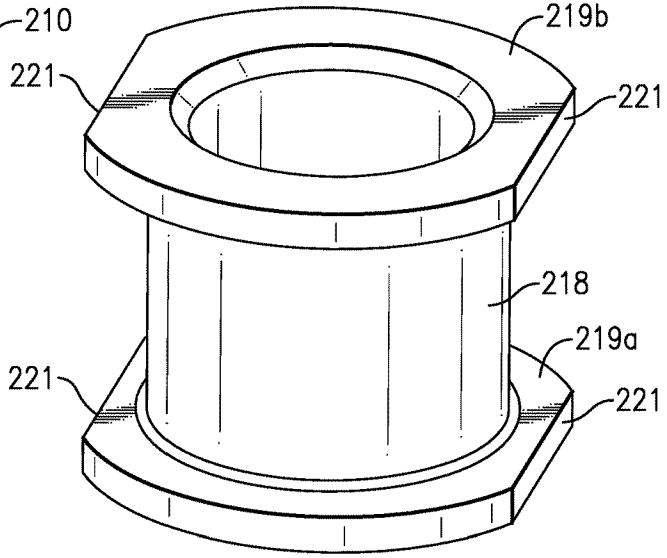
FIG. 7*b* illustrates an alternate outer bushing.
Figure 7A:
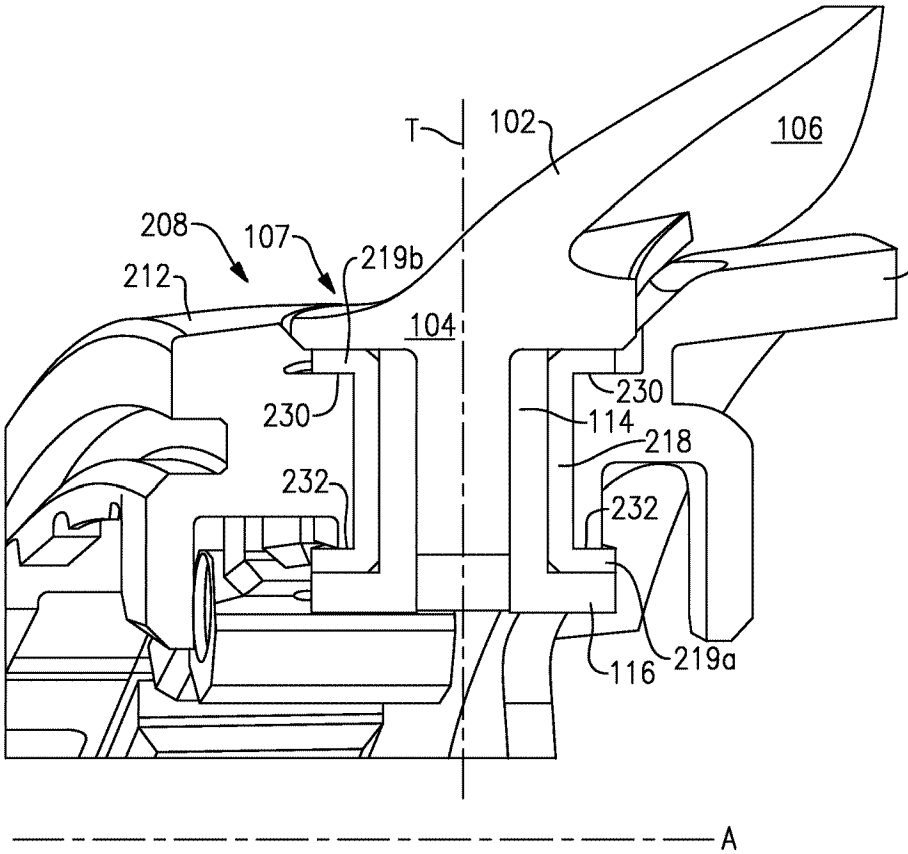
FIG. 7*a* illustrates a cross-sectional view of an alternate variable vane assembly.

FIGS. 7*a-b* show an alternate bushing 218 and shroud 208. In this example, the outer bushing 218 includes first and second outer bushing flanges 219*a*, 219*b*. The first and second outer bushing flanges are on the radially inner and outer ends of the outer bushing 118 with respect to the engine axis X, respectively. The outer flange 219*b* is retained in the shroud 208 by shoulders 230, preventing radial movement of the outer bushing 218 towards the engine axis X. Similarly, the inner flange 219*a* is retained by shoulders 232, preventing radial movement of the outer flange away from the engine axis X. The inner bushing 114 is received inside the outer bushing 218. The flange 116 on the inner bushing 114 is also retained by the shoulders 232, and is disposed radially inward from the inner outer bushing flange 219*a* with respect to the engine axis X.

Figure 7C:
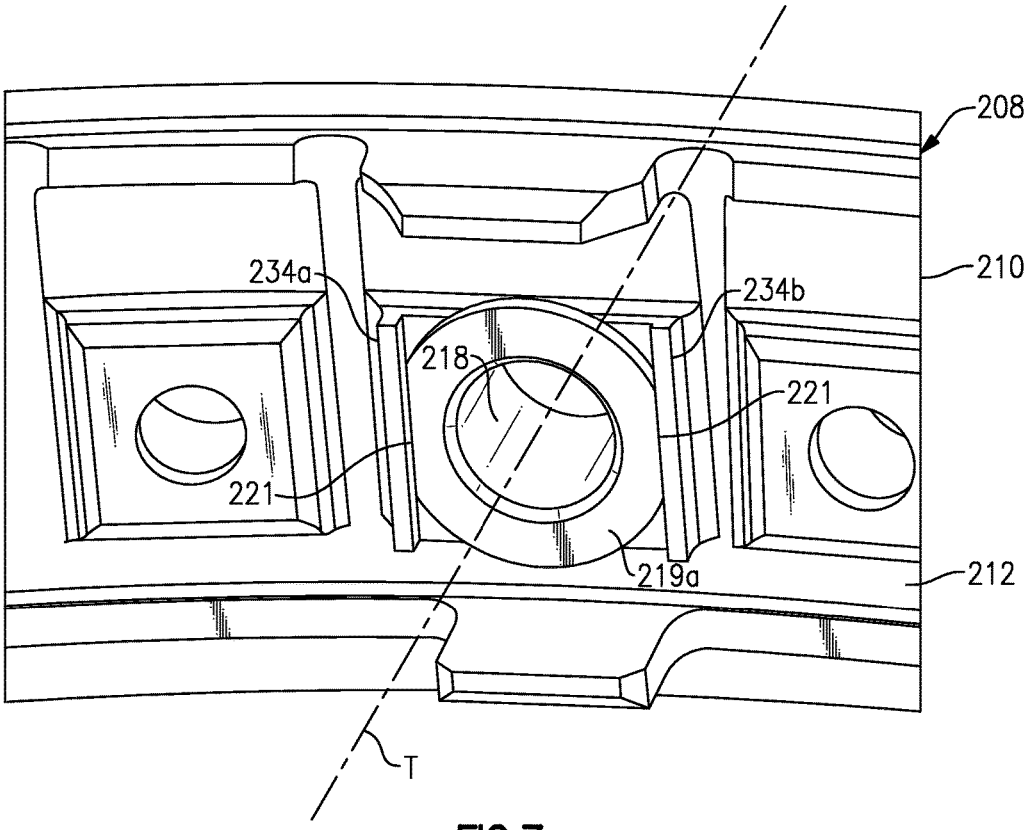
FIG. 7*c* illustrates the alternate outer bushing of FIG. 7*b* installed in an alternate shroud.

The flanges 219*a*, 219*b* may include at least one flat edge 221 which serves as an anti-rotation feature. In the example shown, the outer bushing flanges 219*a*, 219*b* each include two flat edges 221 spaced circumferentially opposite from one another. Referring to FIG. 7*c*, the flat edges 221 of the inner flanges 219*a* abut first and second axial lips 234*a*, 234*b* formed in the shroud 208, preventing the outer bushing 218 from rotating along the trunnion axis T.

Similar to the previous example, the trunnion 104 and the inner bushing 114 are mated in a press fit relationship, retaining the trunnion 104 in the inner bushing 114. The inner bushing 114 is retained in the outer bushing 218 by the inner bushing flange 116. The outer bushing 218 is retained in the shroud 208 by the inner and outer flanges 219*a*, 219*b*.

Although example embodiments have been disclosed, a worker of ordinary skill in this art would recognize that certain modifications would come within the scope of the claims. For that reason, the following claims should be studied to determine their true scope and content.

What is claimed is:

1. A variable vane assembly, comprising:

a variable vane;

a trunnion arranged on one end of the variable vane;

an inner bushing mated to the trunnion in a press fit relationship, the inner bushing having a first end adjacent the variable vane and a second end opposite from the first end;

an outer bushing configured to rotatably receive the inner bushing for rotation about an axis; and a retention feature on the second end of the inner bushing that abuts an end of the outer bushing to retain the trunnion with respect to the outer bushing.

2. The variable vane assembly according to claim 1, wherein the retention feature is a flange formed on the inner bushing.

3. The variable vane assembly according to claim 2, wherein the flange abuts an end of the outer bushing to prevent axial movement of the flange and the trunnion with respect to the outer bushing along the axis.

4. The variable vane assembly according to claim 1, wherein the outer bushing includes an anti-rotation feature.

5. The variable vane assembly according to claim 4, wherein the anti-rotation feature is at least one protrusion extending radially from an outer surface of the outer bushing with respect to the axis.

6. The variable vane assembly according to claim 4, wherein the outer bushing includes at least one outer bushing flange.

7. The variable vane assembly according to claim 6, wherein the anti-rotation feature is at least one flat edge formed in the at least one outer bushing flange.

8. The variable vane assembly according to claim 1, wherein at least one of the inner and outer bushings are metallic.

9. The variable vane assembly according to claim 1, wherein the inner and outer bushings are made from the same material.

10. A gas turbine engine, comprising:

a shroud having a recesses;

a variable vane including first and second trunnions at first and second ends of the variable vane, respectively;

an inner bushing configured to receive the first trunnion in a press fit relationship;

an outer bushing configured to rotatably receive the inner bushing for rotation about an axis, the outer bushing arranged in the recess;

a retention feature abutting an end of the outer bushing to retain the first trunnion along the axis with respect to the outer bushing to prevent the inner bushing from moving axially away from a central engine axis, wherein the retention feature is a flange formed on the inner bushing; and an actuator configured to rotate the variable vane via the second trunnion.

11. The gas turbine engine according to claim 10, wherein the outer bushing includes an anti-rotation feature.

12. The gas turbine engine according to claim 11, wherein the shroud is configured to mate with the anti-rotation feature.

13. The gas turbine engine according to claim 10, wherein the first trunnion is radially inwards from the second trunnion with respect to a central axis of the gas turbine engine.

14. A method of assembling a variable vane assembly, comprising the steps of:

installing a trunnion of a variable vane into an inner bushing in a press fit relationship;

installing the inner bushing into an outer bushing to create a bushing assembly, the inner bushing having a first end adjacent the variable vane and a second end opposite the first end; and retaining the trunnion in the bushing assembly via a retention feature on the second end of the inner bushing, the retention feature abutting an end of the outer bushing.

15. The method according to claim 14, further including the step of installing the bushing assembly into a shroud.

16. The method according to claim 15, further including the step of rotating the variable vane with respect to the shroud.

17. The method according to claim 14, further including the step of preventing rotation of the outer bushing relative to the shroud via an anti-rotation feature.

* * * * *